United States Patent [19]

Krizan

[11] 4,046,312

[45] Sept. 6, 1977

[54] SECURITY TOTE BOX

[75] Inventor: Bradford J. Krizan, Plymouth, Minn.

[73] Assignee: Liberty Carton Co., Minneapolis, Minn.

[21] Appl. No.: 661,346

[22] Filed: Feb. 25, 1976

[51] Int. Cl.[2] ..... B65D 45/00

[52] U.S. Cl. ..... 229/45 R; 220/324; 224/45 P

[58] Field of Search ..... 224/45 P, 42.1 E; 220/324, 19, 83; 229/43, 45, 47, 37 E; 292/253, 246, 88, 87, 89, 80, DIG. 11

[56] References Cited

U.S. PATENT DOCUMENTS

| | | | |
|---|---|---|---|
| 882,094 | 3/1908 | Boyd | 292/303 |
| 886,530 | 5/1908 | Mestemacher | 220/4 F |
| 2,193,925 | 3/1940 | Huye | 229/45 X |
| 2,650,443 | 9/1953 | Trumbo | 49/396 X |
| 2,709,313 | 5/1955 | Nead | 49/396 X |
| 2,762,522 | 9/1956 | Hogan | 292/253 X |
| 3,685,719. | 8/1972 | Goldman | 220/324 X |

FOREIGN PATENT DOCUMENTS

| | | | |
|---|---|---|---|
| 622,399 | 9/1962 | Belgium | 229/DIG. 11 |

*Primary Examiner*—Albert J. Makay
*Assistant Examiner*—Donald W. Underwood
*Attorney, Agent, or Firm*—Williamson, Bains & Moore

[57] ABSTRACT

A tote box having a rigid reinforcing rim extending around its top periphery is provided with a removable lid which is secured in place by a rigid locking tongue biased into locking engagement with an exposed locking segment of the reinforcing rim. The lid is also preferably strengthened by a rigid rim to which the locking tongue is affixed. Downwardly depending side panels on the lid are folded to define pockets within which the lid rim is contained, and corner retention bar members on the lid rim are engaged under exposed corner segments of the box reinforcing rim to cooperate with the locking tongue in holding the lid securely locked in place.

5 Claims, 5 Drawing Figures

SECURITY TOTE BOX

BRIEF SUMMARY OF THE INVENTION

This invention is directed to a lightweight, tamperproof tote box having a lid that can be removed for loading and unloading the box, and quickly and easily secured in place in locking engagement with the top of the box to render the contents safe and secure. The security box can be utilized for handling and shipping various kinds of articles, the primary application being for handling mail.

These basic objectives are realized by making the separate container and lid from single blanks of lightweight, corrugated fiberboard and reinforcing each with a rigid rim, with locking members on the lid rim being positioned and shaped to restrainably engage complementary locking segments on the container rim.

Advantageously, the box rim is contained within pockets formed around the top of the tote box by folding the box sidewalls dowmwardly to provide a double wall thickness. The fiberboard material is cut away around the top of the tote box to expose a horizontal locking segment of the box rim with which a locking tongue on the lid rim is engaged. Preferably, the upwardly projecting lid locking tongue is urged under and behind the locking segment of the box rim in restraining engagement therewith.

Particularly secure attachment of the lid to the box is achieved by providing a pair of corner retention bar members on the lid rim adapted to be engaged with exposed corner segments of the box reinforcing rim on the opposite side thereof from its exposed locking segment. As the locking tongue on the lid is forced into restraining engagement with the locking segment on the box rim, the corner retention bar members on the lid rim are biased under the exposed corner segments of the box rim.

As a particular benefit for security purposes, the retention bar members on the lid rim are fully concealed under the lid and inside of the lid sidewalls when the lid is in place on the box, with the lid rim being contained within pockets defined by downwardly depending lid side panels folded over on themselves.

These and other objects and advantages of my invention will be readily apparent as the following description is read in conjunction with the accompanying drawings wherein like reference numerals have been used to designate like elements throughout the several views.

DESCRIPTION OF THE PREFERRED EMBODIMENT

Figure 2:
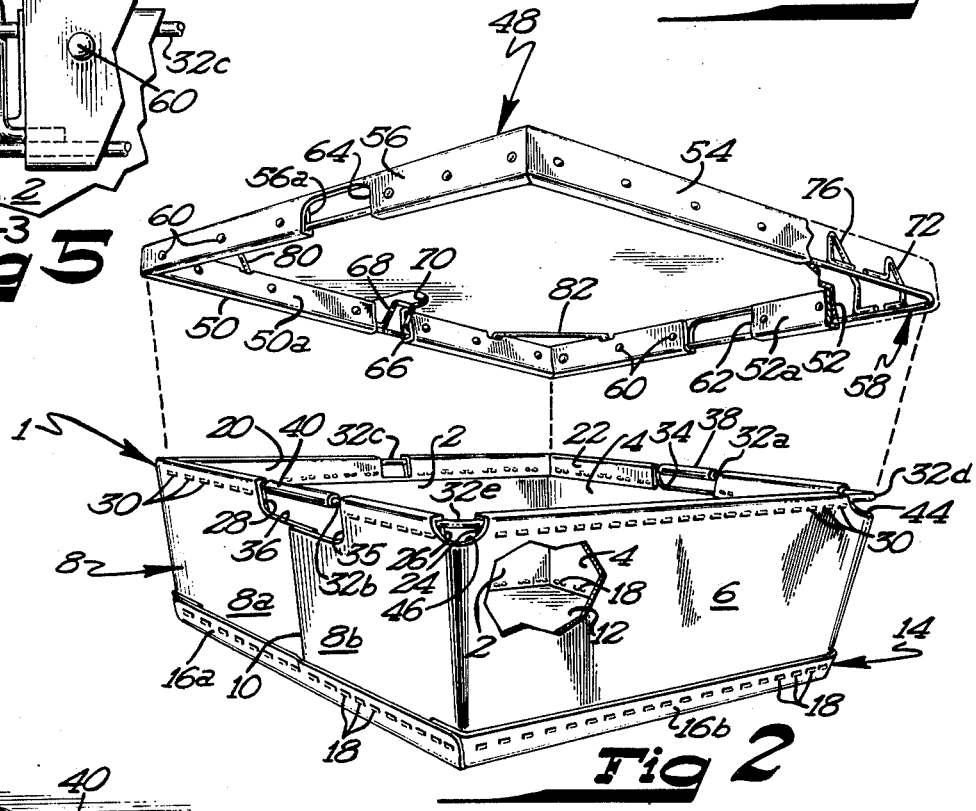
FIG. 2 is an exploded, perspective view of the box and lid combination showing the lid removed.

With reference to the drawings, I have shown in FIG. 2 a preferred form of the portable container of this invention. The container is generally indicated by reference numeral 1. It is comprised of four upstanding sidewalls 2, 4, 6 and 8 formed into a generally rectangular configuration as shown. Although the container may be made from various materials including metal, it is preferably made from a single blank of corrugated fiberboard folded along score lines to provide the upstanding sidewalls 2, 4, 6 and 8. The free end segments **8*a* and 8*b* of fiberboard wall 8 are joined together along an upright joint 10 to secure the container in the desired rectangular shape. End segments 8*a* and 8*b* of the fiberboard blank may be joined together along joint 10** in any manner desired, a glued joint being preferred.

The bottom wall 12 of the container extends between the bottom edge portions of sidewalls 2, 4, 6 and 8. Although the bottom wall could also be made from corrugated fiberboard, I prefer to utilize a moisture impervious, base tray for this purpose. High density polyethylene has proven to be a particularly satisfactory material for base tray 14 to provide the desired properties of light weight, hardness, durability and moisture imperviousness. Base tray 14 is preferably molded as an integral unit from such plastic material to form bottom wall 12 and upstanding side and end panels which vertically overlap the bottom ends of each of the container sidewalls 2, 4, 6 and 8 as shown with respect to base tray side panels **16*a* and 16*b* in FIG. 2. Fiberboard sidewalls 2, 4, 6 and 8 are fitted inside of base tray 14 and are secured to the overlapping tray side panels by any suitable means, such as by staples 18**.

Each of the container sidewalls 2, 4, 6 and 8 is folded over and downwardly along the top edge thereof. These downwardly folded, hinged flaps for sidewalls 2, 4 and 6 are designated by reference numerals 20, 22 and 24 respectively. Sidewall segments **8*a* and 8*b* have downwardly folded, top flaps 26 and 28. All of these hinged flaps 20–28 are secured in the downwardly folded positions shown in overlapping relation to the top ends of their respective sidewalls by staples 30. This provides a pocket around the entire upper periphery of container 1 within which a rigid, reinforcing rim 32 of metal or other suitable material is contained. A hand grip opening 34 is cut in the top end of sidewall 4. Also, a pair of mating notches 35 and 36 are cut in the top ends of sidewall segments 8*a* and 8*b* to provide a continuous hand grip opening when these wall segments are secured together along joint 10. With reinforcing rim 32 extending around the top extremity of the container sidewalls 2, 4, 6 and 8 within the top ends of the pockets defined by downwardly turned flaps 20–28, intermediate segments 32*a* and 32*b* of rim 32 will define hand grips extending across the tops of the openings defined by sidewall notches 34, 35 and 36. Gripping handles 38 and 40 of wood, plastic or other suited material are provided on the hand grip portions 32*a* and 32*b* of rim 32**.

For purposes of securing a lid in place as hereinafter explained, fiberboard sidewall 2 and its hinged top flap 20 are cut away at 42 in the form of a notch to expose a horizontal locking segment **32*c* of container rim 32. Locking segment 32*c* is preferably provided between the ends of container sidewall 2**. Additional lid hold down means in the form of exposed corner segments 32*d* and 32*e* of rim 32 are provided on the opposite ends of container sidewalls 6, opposite to sidewall 2. This is accomplished by cutting away the top corners of the container at the opposite ends of sidewall 6, as indicated by corner cutouts 44 and 46.

For protection of articles being conveyed in container 1, a removable lid generally indicated by reference numeral 48 is provided. Lid 48 is also preferably made from the same corrugated fiberboard material utilized to form the container sidewalls. The bendable fiberboard of the lid is folded downwardly along score lines to provide downwardly depending lid side panels 50, 52, 54 and 56. These lid side panels are folded upwardly on themselves as shown in FIG. 2 with upwardly turned flaps 50*a*, 52*a*, 54*a* and 56*a* overlapping lid side panels 50–56 respectively. This lid side panel construction provides a pocket around the entire periphery of lid 48 within which a strengthening rim 58 is contained. Rivets 60 or other suitable fastening means hold the overlapped lid side panels and flaps 50, 50*a* and 52, 52*a* and 54, 54*a* and 56, 56*a* in place as shown for positive retention of lid rim 58. Lid rim 58 preferably extends around the bottom of the lid side pockets as illustrated most clearly in FIGS. 2 and 4. Lid side panel 50 and its overlapping flap 58 are notched or cut away at 66 as illustrated in FIG. 2. This serves to expose a lid locking member in the form of a tongue 68. The top of lid 48 is also notched at 70, opposite side panel notch 66, for a purpose hereinafter set forth.

Figure 1:
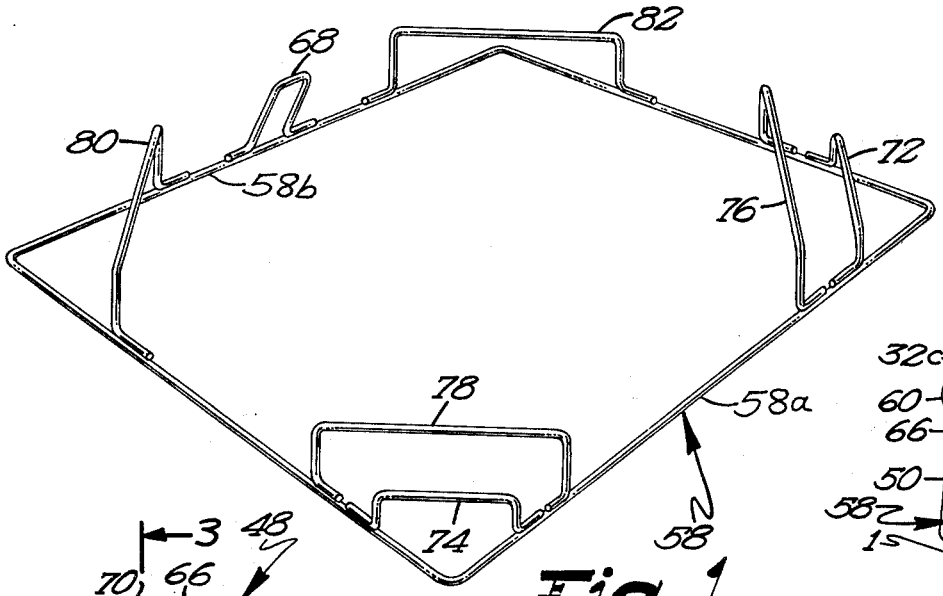
FIG. 1 is a top, perspective view of the strengthening rim for the box lid.
Figure 3:
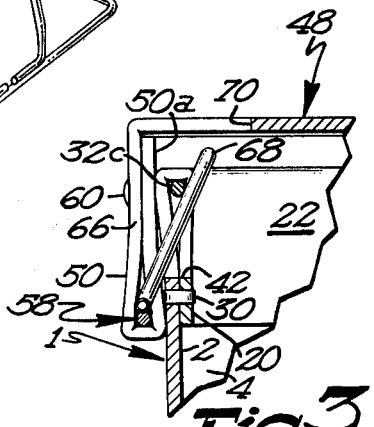
FIG. 3 is a fragmentary, vertical section view showing the locking engagement of the lid locking tongue with the box when the lid is in place, and taken along lines 3—3 of FIG. 5.

Lid rim 58 is illustrated in a perspective view in FIG. 1. It is to be noted that lid locking tongue 68 is in the form of a U-shaped member having base feet which are welded, soldered or otherwise secured to one of the side leg segments of rim 58. With rim 58 in position in the side pockets of lid 48, locking tongue 68 projects generally inwardly and upwardly therefrom as shown in FIGS. 1 and 3. Extending diagonally across two corners of lid rim 58 are a pair of retention bar members 72 and 74. These retention bars are preferably positioned across the corners of rim 58 at the opposite ends of the side segment 58*a* thereof which is opposite to rim segment 58*b* to which locking tongue 68 is attached. This is for the purpose of achieving effective locking engagement of lid 48 with container 1 as explained below. Each of the retention bar members 72 and 74 is of inverted, U-shaped configuration as shown. These retention bar members project upwardly from rim 58 in its normal position of use on lid 48. Extension feet on the opposite ends of retention bars 72 and 74 are utilized to weld them to adjacent side legs of rim 58. Corner reinforcing bars 76, 78, 80 and 82 are secured diagonally across the four corners of rim 58. These reinforcing bars are secured to rim 58 by welding or soldering in the same manner as are retention bars 72 and 74. They are also of inverted, U-shaped configuration as shown to cooperate with the top, corners of container 1 for stacking strength in the manner set forth below.

Figure 5:
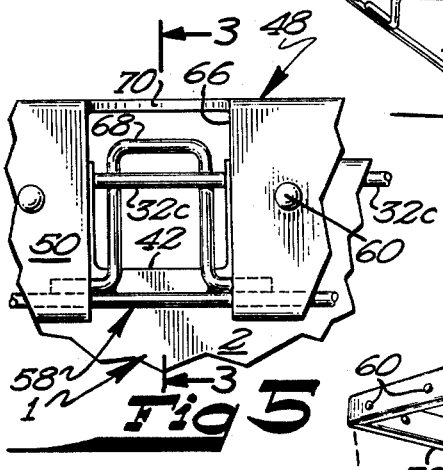
FIG. 5 is a fragmentary, front elevation view of the box and lid showing the locking engagement of the lid locking tongue with the box when the lid is in place.

In utilizing container, lid 48 will be removed when articles are being deposited inside of the container. Lid 48 is placed on top of the container for secure transportation and handling of the articles placed within the container. Lid 48 is positioned on top of the container sidewalls 2, 4, 6 and 8 with its locking tongue 68 in alignment with locking segment 32*c* of container rim 32. The side of lid 48 with locking tongue 68 thereon will be tipped downwardly slightly to force upwardly extending tongue 68 under and behind locking segment 32*c* of rim 32 as this front side of lid 48 is then pulled upwardly. This serves to restrainably engage locking tongue 68 under and behind locking segment 32*c* in the position illustrated in FIGS. 3 and 5. With locking tongue 68 thus in restraining engagement with locking segment 32*c*, the opposite, rear side of lid 48 is brought downwardly tightly against the top edges of container walls 2, 4 and 6. As the lid is forced rearwardly in a direction away from locking tongue 68, retention bar members 72 and 74 are brought up under exposed corner segments 32*d* and 32*e* of reinforcing rim 32. With lid 48 resting firmly and flatly on the top edge portions of the container sidewalls, retention bars 72 and 74 will abut against the underside of exposed corner segments 32*d* and 32*e* of container rim 32 in the manner illustrated in FIG. 4. The biasing action of locking tongue 68 against locking segment 32*c*, on the opposite side of container 1 from sidewall having exposed corner segments 32*d* and 32*e* of rim 32 at the opposite ends thereof, will urge retention bars 72 and 74 tightly inwardly under complimentary, exposed corner segments 32*d* and 32*e* of rim 32.

Figure 4:
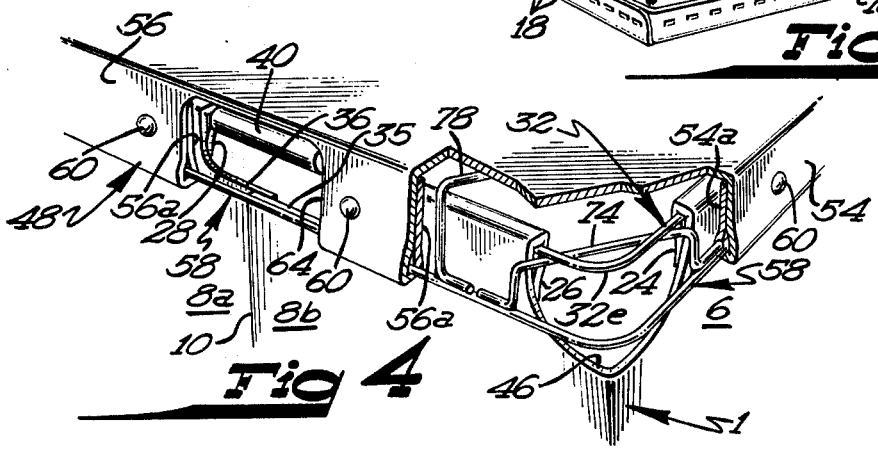
FIG. 4 is a fragmentary, perspective view of one corner of the tote box, partially broken away, to show the corner lock arrangement of the lid to the box.

With lid 48 tightly secured on top of the container sidewalls in the aforesaid manner, lid side panels 50, 52, 54 and 56 will depend downwardly over the upper ends of the container sidewalls in the manner illustrated in FIGS. 3 and 4. Retention bars 72 and 74 of lid rim 58 will be concealed from view under the lid and inside of the lid side panels 52, 54 and 56. Since the corner lock arrangement between lid rim retention bars 72 and 74 and container rim corner segments 32*d* and 32*e* is not visible when the lid is in place, security is enhanced. Absolute protection for materials contained within the tote box can be ensured by placing a padlock around the upper, cross member of locking tongue 68 and locking segment 32*c* of the container rim 32. The attachment of a lock is facilitated by cutaway portion or notch 70 in lid 48 directly above locking tongue 68. It is to be noted that lid 48 is cut away along opposed side panels 52, 52*a* and 56, 56*a* to provide notches 62 and 64 in alignment with the hand grip openings on container 1 defined by cutaway portions 34, 35 and 36. This permits gripping access to hand grips 38 and 40 when lid 48 is in place. The attachment of at least two corners of lid 48 to adjacent corners of container 1 on the opposite side thereof from rim locking segment 32, through the engagement of lid rim retention bars 72 and 74 with container rim corner segments 32*d* and 32*e* ensures that lid 48 will be held securely and uniformly in place on top of container 1 during handling and transportation.

It is to be noted that with lid 48 in its closed position over the top of container 1, and with lid side panels 50–56 depending downwardly over the outside of the upper ends of the container sidewalls, corner braces 76, 78, 80 and 82 will be disposed in overlying relation to the adjacent corners of container 1. As is illustrated with respect to corner brace 78 in FIG. 4, these lid reinforcing bars or braces 76, 78, 80 and 82 will extend diagonally over the top edges of container 1, across the corners thereof in overlying relation to container rim 32. This is accomplished by the inverted U-shaped configuration of the corner braces 76, 78, 80 and 82, these braces having sufficient height that they will clear the top edges of the container sidewalls with lid 48 in place, and corner retention bars 72 and 74 extending under exposed corner segments 32*d* and 32*e* of container rim 32 in abutting engagement therewith. Lid cross braces 76, 78, 80 and 82 lend considerable stacking strength to the container, and increase the ability of the container to support weights placed on top thereof. The increased stacking strength derived from cross braces 76, 78, 80 and 82 is enhanced by the support given to these cross braces by container rim 32, on which the cross braces rest when the lid is closed.

Although the security tote box disclosed herein has been particularly developed with a view towards shipping and handling mail, I contemplate that it may be used for handling various other articles where security and protection from weather elements are a concern. The corrugated fiberboard container and lid, in combination with the metal reinforcing rims utilized therein provides a particularly strong and durable container of very lightweight construction for ease of handling.

I anticipate that various changes may be made in the size, shape, construction and arrangement of the container and its interlocking lid, without departing from the spirit and scope of my invention as defined by the following claims:

What is claimed is:

1. A tote box with a security lid comprising:

a container comprised of four upstanding sidewalls disposed in a generally rectangular configuration;

a bottom wall extending between the bottom edge portions of said sidewalls;

a rigid reinforcing rim extending around the top periphery of said container;

means holding said rim in engagement with top edge portions of said sidewalls;

at least one exposed, horizontal locking segment of said reinforcing rim;

a lid positioned on top of said sidewalls in covering relation to said container, said lid being formed from bendable material and having side panels depending downwardly over the top ends of said container sidewalls and folded upwardly on themselves to define pockets around the periphery of said lid within which a strengthening rim is contained;

a locking tongue on said lid strengthening rim in alignment with said locking segment of said reinforcing rim, said locking tongue projecting unwardly and being biased under said locking segment of said container rim in restraining engagement therewith to secure said lid on top of said container sidewalls; and means holding said lid in engagement with top portions of said container peripherally spaced apart from said container rim locking segment comprising two exposed corner segments of said container reinforcing rim, and corner retention bar members extending angularly across two corners of said lid strengthening rim, said retention bar members being positioned under said container reinforcing rim corner segments in restraining engagement therewith to biase said locking tongue when said locking tongue is in engagement with said locking segment of said container reinforcing rim.

2. A tote box as defined in claim 1 wherein:

said container side walls are formed from a single piece of flexible material folded downwardly along the top edge of each of said sidewalls and secured in overlapping relation thereto to define pockets around the top of said container within which said reinforcing rim is contained, and said flexible material being cut away along the top of one of said side walls to expose said locking segment of said reinforcing rim.

3. A tote box as defined in claim 1 wherein:

each of said retention bar members of said lid rim project upwardly from said rim in an inverted, U-shaped configuration, whereby said lid can rest flat on the top edge portions of said container sidewalls with said lid side panels depending downwardly over the top ends of said container sidewalls, and said retention bar members of said lid rim abutting against the underside of said exposed corner segments of said container reinforcing rim.

4. A tote box as defined in claim 1 wherein:

at least two corner reinforcing bars extend diagonally across at least two corners of said lid rim, said corner reinforcing bars extending over adjacent corners of said container in overlying relation to said container rim for support thereon when said lid is positioned in covering relation to the top of said container.

5. A tote box as defined in claim 1 wherein:

said lid strengthening rim extends around the bottoms of said lid pockets and said locking tongue is inclined in an inwardly and upwardly projecting direction from said strengthening rim for removable insertion under said locking segment of said container reinforcing rim.

* * * * *

UNITED STATES PATENT AND TRADEMARK OFFICE

CERTIFICATE OF CORRECTION

PATENT NO. : 4,046,312

DATED : September 6, 1977

INVENTOR(S) : Bradford J. Krizan

It is certified that error appears in the above-identified patent and that said Letters Patent are hereby corrected as shown below:

In claim 1, column 5, line 44, change "projecting un-" to --projecting up- --.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*